US009937552B2

(12) United States Patent
Palmer et al.

(10) Patent No.: US 9,937,552 B2
(45) Date of Patent: Apr. 10, 2018

(54) ROLLOVER MACHINE WITH SAFETY BRAKING MECHANISM

(71) Applicant: Palmer Manufacturing and Supply, Inc., Springfield, OH (US)

(72) Inventors: John S. Palmer, Springfield, OH (US); Marc Zerkle, New Carlisle, OH (US)

(73) Assignee: Palmer Manufacturing And Supply, Inc., Springfield, OH (US)

( * ) Notice: Subject to any disclaimer, the term of this patent is extended or adjusted under 35 U.S.C. 154(b) by 146 days.

(21) Appl. No.: 15/152,158

(22) Filed: May 11, 2016

(65) Prior Publication Data

US 2016/0332218 A1 Nov. 17, 2016

Related U.S. Application Data

(60) Provisional application No. 62/160,141, filed on May 12, 2015.

(51) Int. Cl.

| | |
|---|---|
| ***B22C 17/12*** | (2006.01) |
| ***B22C 19/04*** | (2006.01) |
| ***B22D 33/02*** | (2006.01) |
| ***B22D 17/08*** | (2006.01) |

(52) U.S. Cl.

CPC ..... *B22C 19/04* (2013.01); *B22C 17/12* (2013.01); *B22D 17/08* (2013.01); *B22D 33/02* (2013.01)

(58) Field of Classification Search

CPC ..... B22C 17/08; B22C 17/12; B22C 17/14; B22C 19/04; B22D 33/02

USPC ..... 164/151.2, 183, 184, 215, 240

See application file for complete search history.

(56) References Cited

U.S. PATENT DOCUMENTS

| | | | | |
|---|---|---|---|---|
| 3,520,347 | A * | 7/1970 | Wolff | B22C 15/24 164/183 |
| 4,124,126 | A * | 11/1978 | Abraham | B22C 17/08 164/224 |
| 7,011,138 | B1 * | 3/2006 | McKibben | B22C 17/08 164/168 |
| 8,777,549 | B2 * | 7/2014 | Shock | B21D 37/14 254/95 |

FOREIGN PATENT DOCUMENTS

JP 59178168 A * 10/1984

* cited by examiner

*Primary Examiner* — Kevin E Yoon

(74) *Attorney, Agent, or Firm* — Harness, Dickey & Pierce, P.L.C.

(57) ABSTRACT

A cylindrical drum is driven for rotation about its axis by a drive mechanism. A braking mechanism selectively applies braking forces to the drum to impede or brake its rotational movement. A first movement sensor senses movement of the drive mechanism while a second movement sensor senses movement of the drum. An electronic comparator circuit compares these sensed movements and generates a control signal when the drive mechanism movement and drum movement are not in synchronism. In response to such loss of synchronism, a control mechanism causes the braking mechanism to apply braking forces.

18 Claims, 22 Drawing Sheets

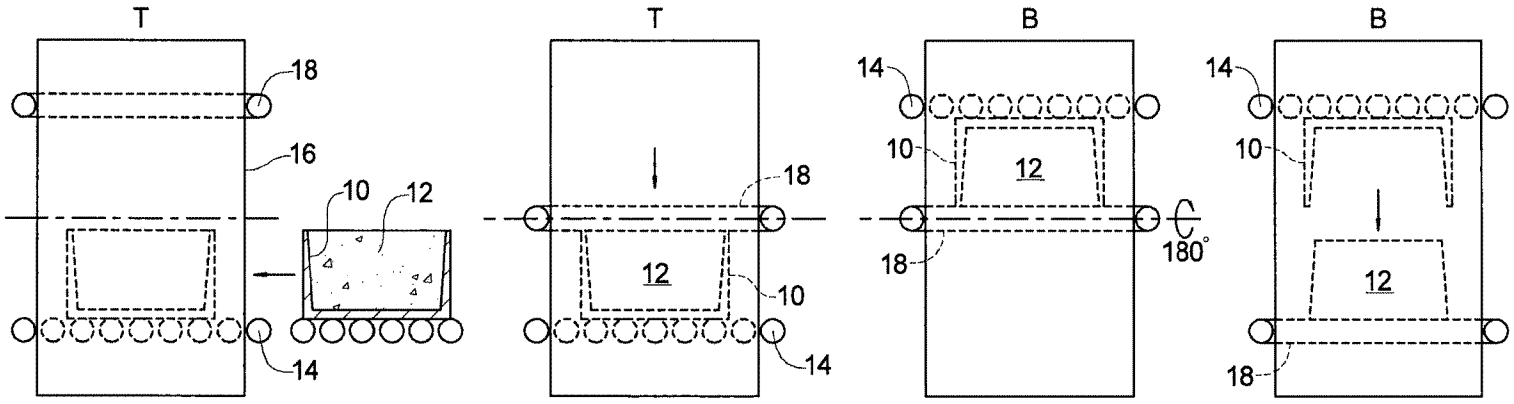
FIG 1A
FIG 1B
FIG 1C
FIG 1D
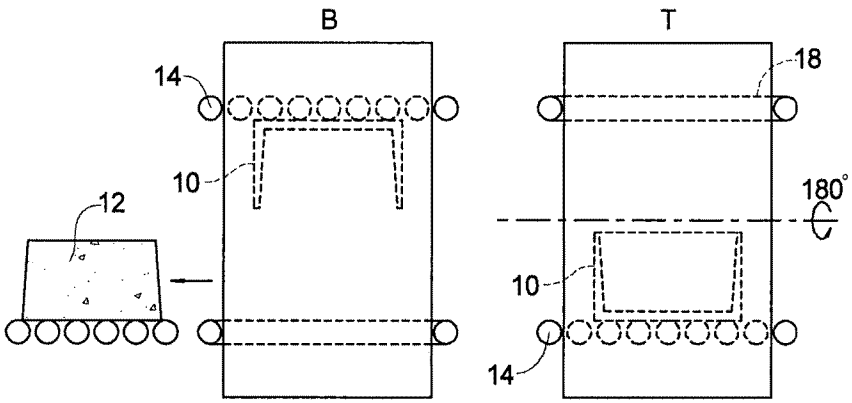
FIG 1E
FIG 1F
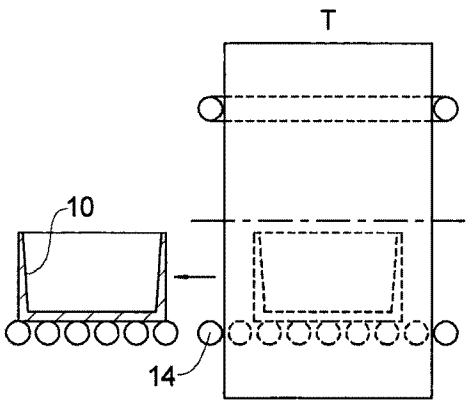
FIG 1G

ROLLOVER MACHINE WITH SAFETY BRAKING MECHANISM

FIELD

The present disclosure relates generally to sand molding equipment used in the foundry industry. More particularly, the disclosure relates to improvements in a rollover machine used to invert a sand mold pattern box.

BACKGROUND

This section provides background information related to the present disclosure which is not necessarily prior art.

Rollover machines are used in the foundry industry to invert heavy sand mold pattern boxes containing sand that defines a mold. Once inverted, the mold is filled with molten metal to form the casting. Rollover machines are typically used in applications where the pattern box and sand are too heavy to be lifted by hand. Rollover machines are thus typically designed to carry very heavy loads and are thus themselves quite massive. For example, a typical rollover machine may weigh 25,000 pounds or more. Machines this massive generate an enormous amount of momentum when moving to invert the pattern box containing sand.

SUMMARY

This section provides a general summary of the disclosure, and is not a comprehensive disclosure of its full scope or all of its features.

In accordance with one aspect, the disclosed rollover machine employs a generally cylindrical drum driven for rotation about its axis by a drive mechanism. A braking mechanism selectively applies braking forces to the drum to thereby impede rotational movement of the drum. A first movement sensor senses movement of the drive mechanism and produces a first output indicative of drive mechanism movement. A second movement sensor senses movement of the drum and produces a second output indicative of drum movement.

An electronic comparator circuit compares the first and second outputs and generates a control signal when the drive mechanism movement and drum movement are not in synchronism. A control mechanism coupled to the comparator circuit and interfaced with the braking mechanism causes the braking mechanism to apply braking forces to the drum when the control signal indicates the drive mechanism movement and drum movement are not in synchronism.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIGS. 1A-1G comprise a sequence of side view diagrams showing the basic operation of a rollover machine;

DETAILED DESCRIPTION

Figure 2:
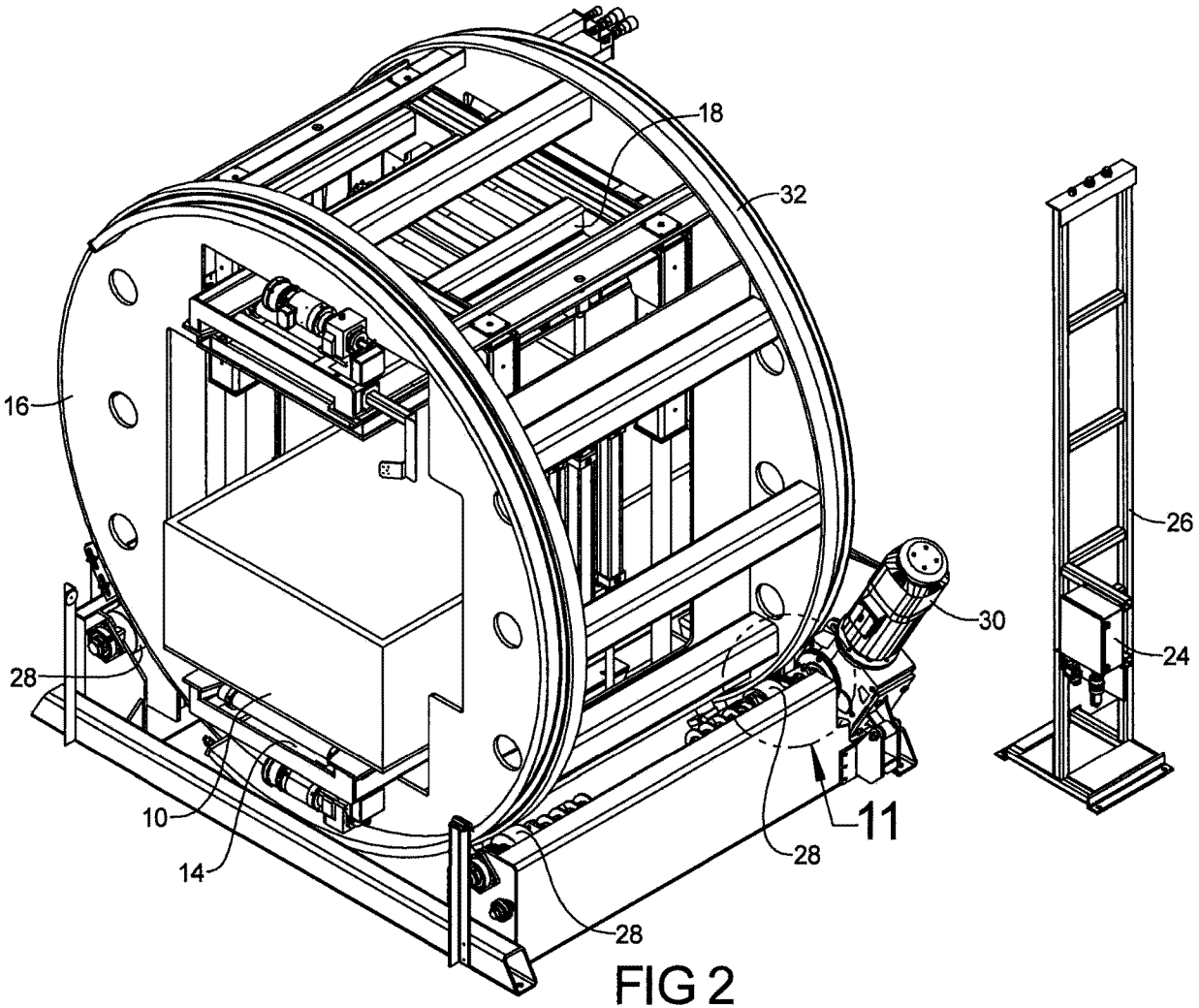
FIG. 2 is a perspective view of the rollover machine.
Figure 3:
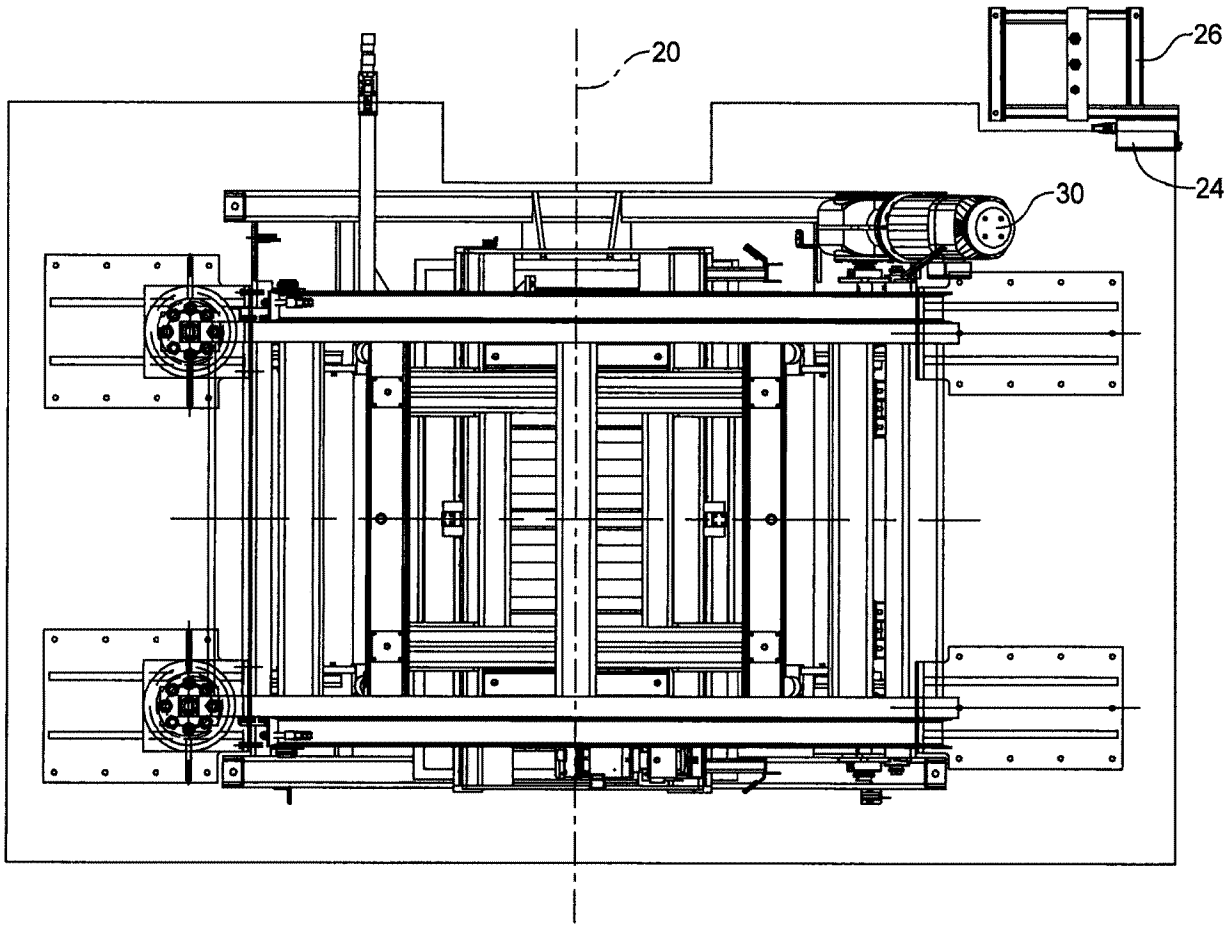
FIG. 3 is a top view of the rollover machine.
Figure 4:
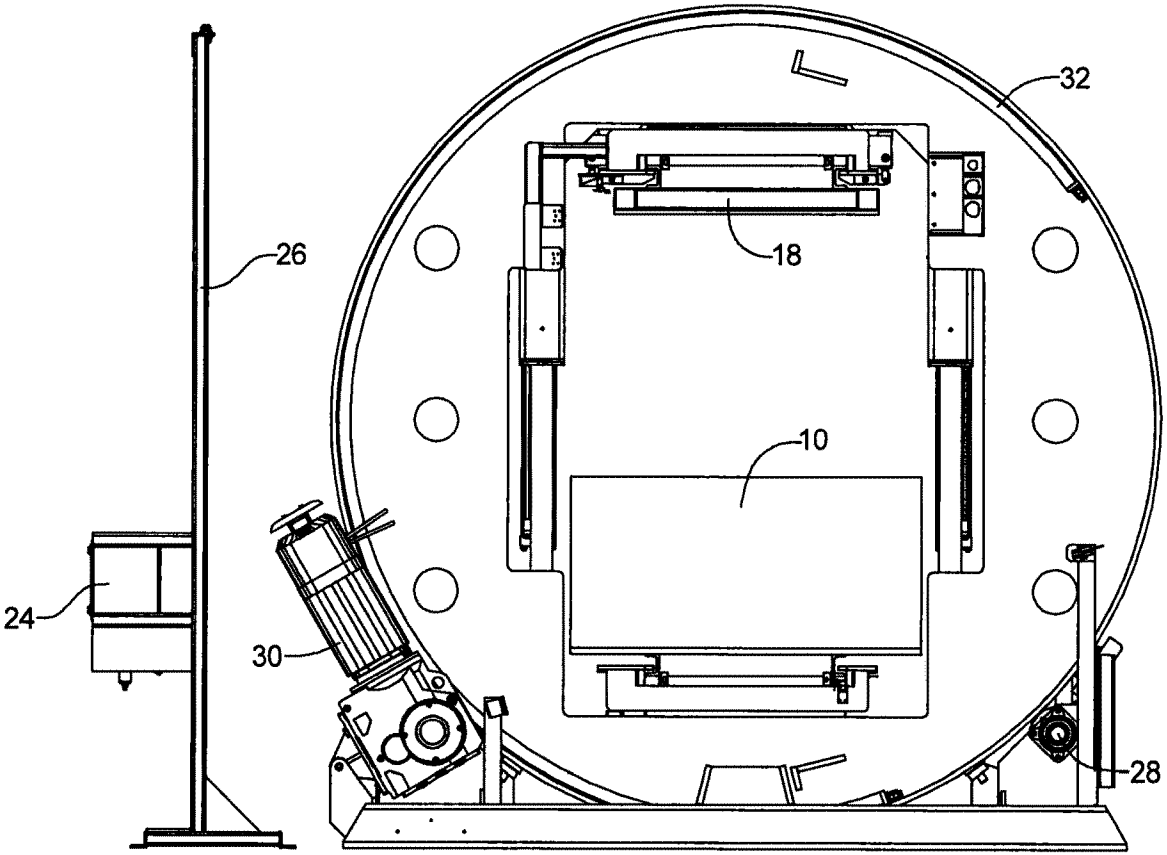
FIG. 4 is an end view of the rollover machine illustrating how the drum is supported on rollers and showing the general position of the chain.
Figure 5:
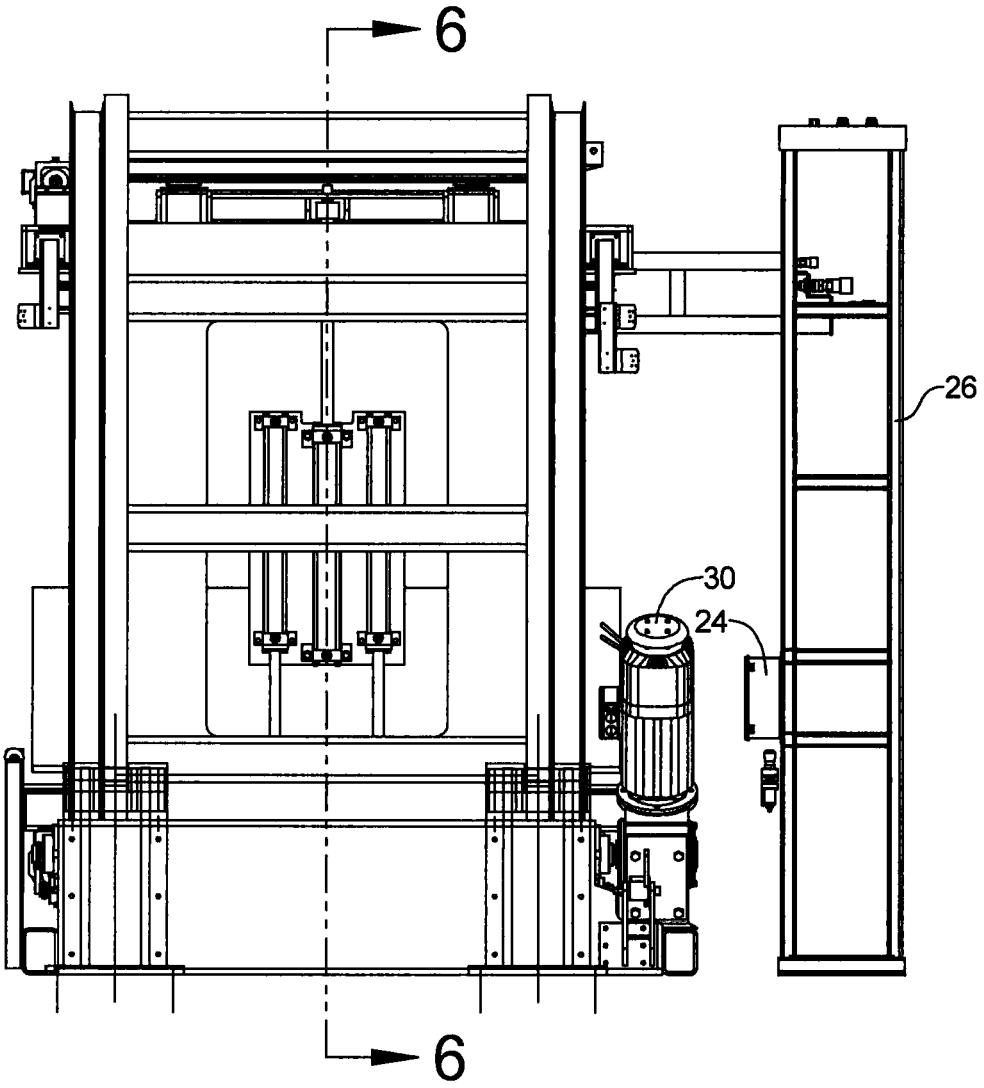
FIG. 5 is a side view of the rollover machine, illustrating how control signals are coupled between the control panel and the machine.

Example embodiments will now be described more fully with reference to the accompanying drawings.

The automatic braking technology disclosed herein represents an important improvement over conventional rollup machinery used in the foundry industry. In order to understand the invention, a basic understanding of the rollover machine operation will be presented.

Referring to FIG. 1A, the pattern box 10 filled with no-bake sand 12 is laterally conveyed onto the lower conveyer assembly 14 located within the interior of the rollover draw machine drum 16. In this orientation, the upper conveyor assembly 18 is positioned well above the pattern box 10.

Next, as seen in FIG. 1B, the upper conveyor assembly 18 is lowered into contact with the open end of the pattern box, as illustrated. Next, as shown in FIG. 1C, the drum 16 is rotated 180° about its central axis 20, resulting in the pattern box and sand being inverted, as shown. Then, as shown in FIG. 1D, the upper conveyor assembly 18 (now supporting the sand 12) is lowered while the pattern box 10 remains held by a clamping mechanism associated with the lower conveyor assembly 14. Because the inner surfaces of the sidewalls of the pattern box are slightly tapered, the sand 12 slides easily apart from the pattern box. Note the sand has a slightly tapered shape or frustum shape that mirrors the tapered inner walls of the pattern box.

With the sand 12 now resting on the upper conveyor 18, it can be removed from the drum as shown in FIG. 1E. Thus, the sand is conveyed laterally onto an adjacent conveyor which conveys the sand downstream to the next processing station (not shown). In order to eject the pattern box from the drum, the drum is again rotated 180° about its access 20, as shown in FIG. 1F. In this orientation, the lower conveyor assembly 14 is once again disposed in its original starting position, as shown in FIG. 1A. The pattern box 10 may then be removed, as shown in FIG. 1G, by conveying it on the same conveyor that took the sand mold downstream. Thus, it will be seen that the rollover draw machine essentially draws the sand from its associated pattern box and then places the inverted sand mold and pattern box sequentially onto a conveyor that transports both to a downstream foundry process.

In a typical application, these rollover draw machines are made in sizes as high as 25,000 pounds and potentially much higher. The operating sequence illustrated in FIGS. 1A-1G is such that when rolling over, the pattern box and sand can potentially be quite a bit off-center. In other words, the rollover draw machine must be of substantial size and strength to accommodate off-center forces as the drum is rotated about its central axis. As will be seen and described in subsequent figures, the typical rollover draw machine is driven by a jackshaft-type drive mechanism that has a pair of chains that are attached to both sides of the drum. In the alternative, cables or gears can be used in place of the chains, to produce axial rotation of the drum about at least a 180-degree range of rotation. When the shaft is driven, the drum rotates in its base frame. Normally, the drive is hydraulic but there are cases where electric drives may be used.

During normal operation, the jackshaft drive system and associated chains are engineered to withstand the substantial forces that exist during operation. With that said, the drum does not rotate at steady state when in use, but rather the drum must rotate 180°—then stop—then rotate 180° again. Thus, angular accelerations are applied to the drive mechanism and chains each time the drum starts and stops rotating. Thus, it has been conventional practice to greatly "over engineer" the loading capacities of the drive mechanism and chain to ensure that the rollover drum cannot jump out of its frame or "freewheel" from the desired loading-unloading position to a point of balance.

The presently disclosed improvement provides further assurance that the drum will not jump out of its frame or freewheel to an undesired position. The solution employs a set of externally-compressing band brakes that compress on the outer diameter of the drum in two instances: (1) any time the system control calls for a stop, and (2) in the event a freewheel condition occurs. To detect the freewheel condition, a presently preferred embodiment uses a pair of rotary encoders, one placed on the drive mechanism and the other placed on the drum (or on a rotating member attached to or communicating with the drum). The control system constantly monitors these encoder outputs and if they do not match exactly, the system causes the compressing band to clamp tightly around the drum, locking it into place. Although different control mechanisms are possible, one embodiment measures the respective rotating speeds of the drive and drum and causes the brakes to be applied when the speeds do not match within predefined tolerances. In addition, the system can send an alarm, allowing a technician to inspect the system prior to starting the cycle again. The encoders may be physically attached, as by clamping to a shaft associated with the drive mechanism (to sense the drive mechanism rotation), and attached to a shaft or roller that moves with the drum (to sense the drum rotation). An encoder that monitors the linear movement of the chain is also possible.

While a pair of encoders has been illustrated here, other sensing techniques and mechanisms can be used instead. Essentially, the braking system uses a control system that has a first sensing point coupled to sense movement of the drum and a second sensing point coupled to sense movement of the drive mechanism, or its associated linkage. The mechanisms used as these two sensing points can be of the same character (e.g., two optical encoders) or they can be of a different character (e.g., an RPM sensor or speed sensor on the drive mechanism and an optical encoder or other type of movement encoder on the drum. The control system works by detecting when detected movement of the drum is not in synchronism with the drive mechanism, such as would happen were the drive chains to break.

Referring now to FIG. 2, the rollover machine is seen in perspective, showing the pattern box 10 resting on the lower conveyor assembly 14, and with upper conveyor assembly 18 disposed in its uppermost position of rest. The control panel 24 is conveniently disposed on a mounting rack 26. Control leads (not shown) connect the control panel 24 to the drive mechanism, actuators and sensors disposed on the rollover machine. The drum 16 is supported on four rollers 28 and rotated about its central axis by a drive motor 30 that couples to lengths of chain 32 disposed about part of the circumference of the drum. Note, the chains 32 require sufficient length to permit the drum to be rotated 180 degrees and then back. Details of the drive motor 30 and associated chain driving mechanism is seen more clearly in FIG. 8.

Figure 8:
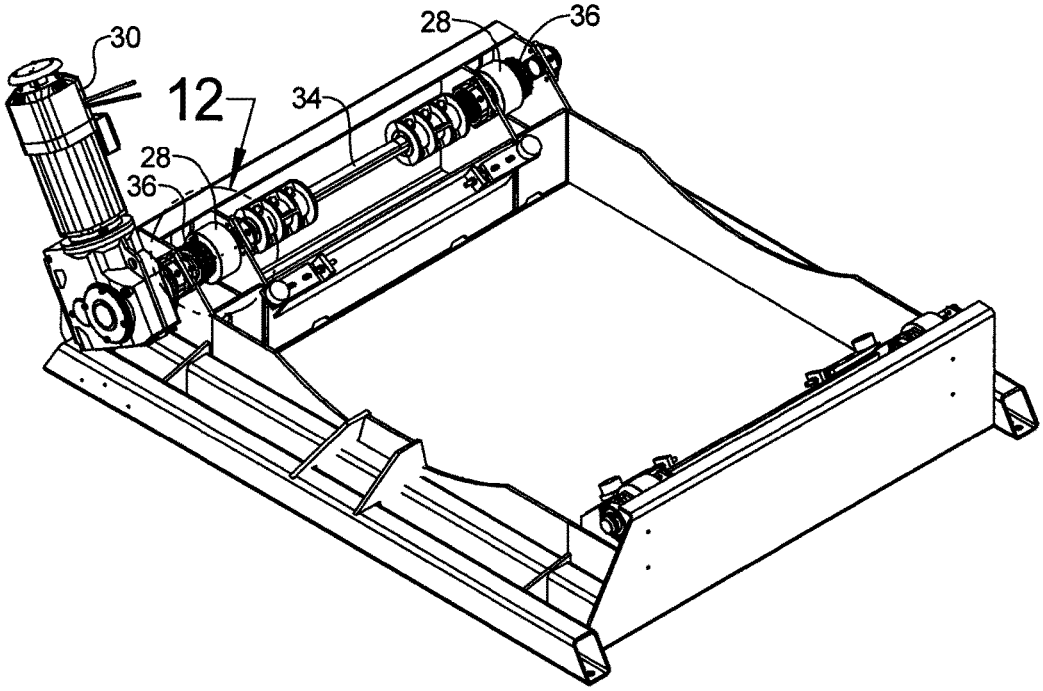
FIG. 8 is a detailed partial view of the base of the rollover machine, showing how the chain drive mechanism is configured.
Figure 9:
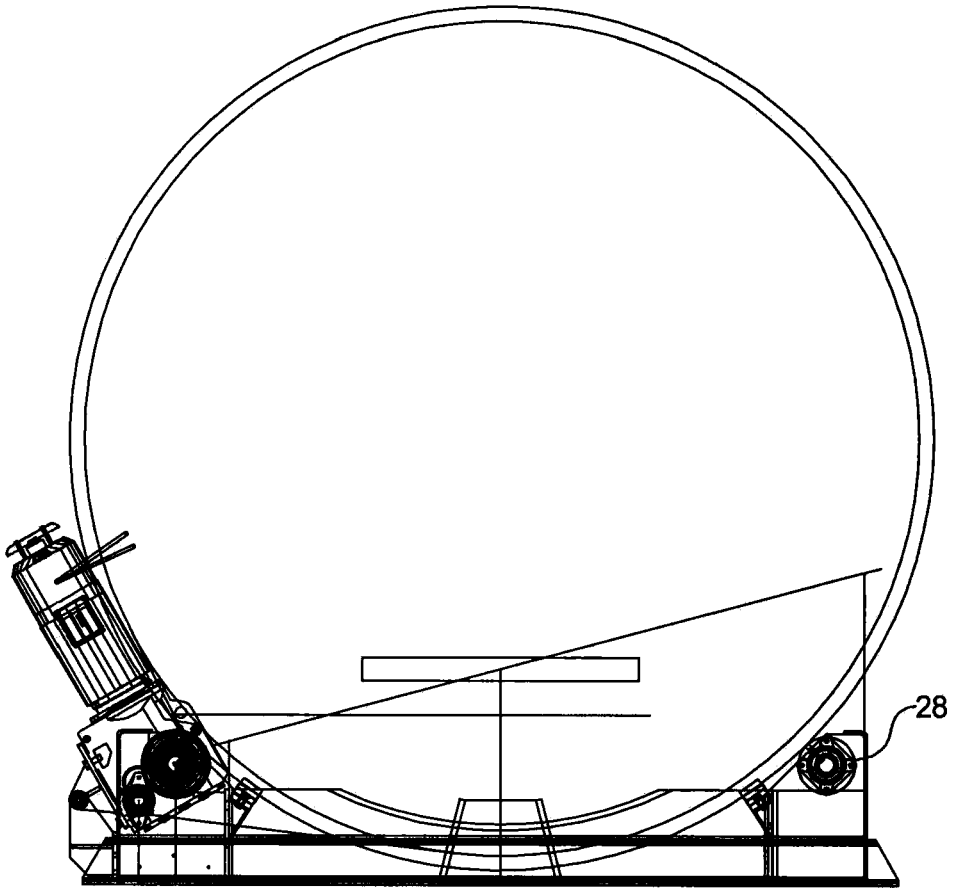
FIG. 9 is a partial view of the rollover machine, showing how the drum is disposed relative to the rollers and mounting frame.
Figure 10:
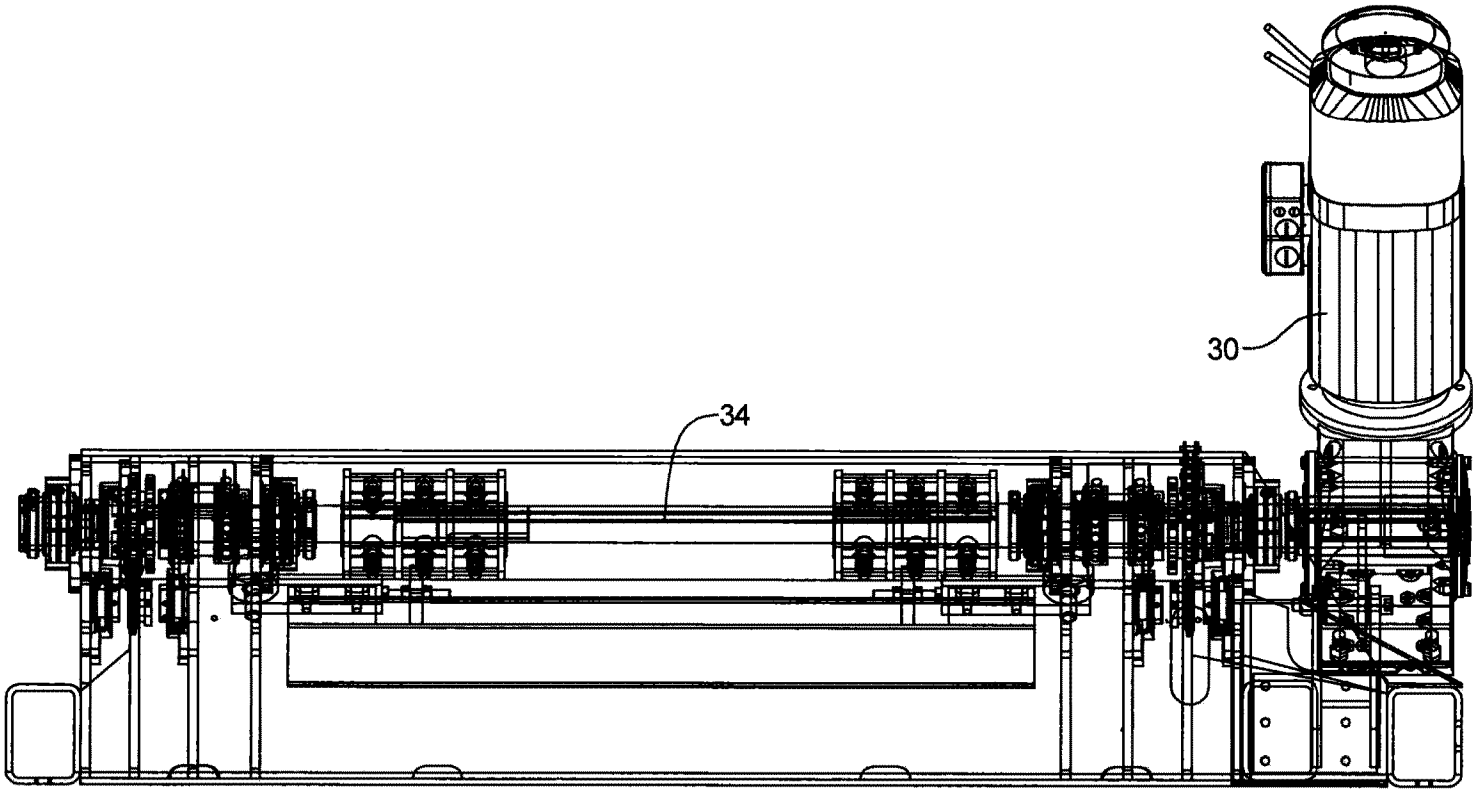
FIG. 10 is a detailed view showing the shaft of the drive mechanism.
Figure 11:
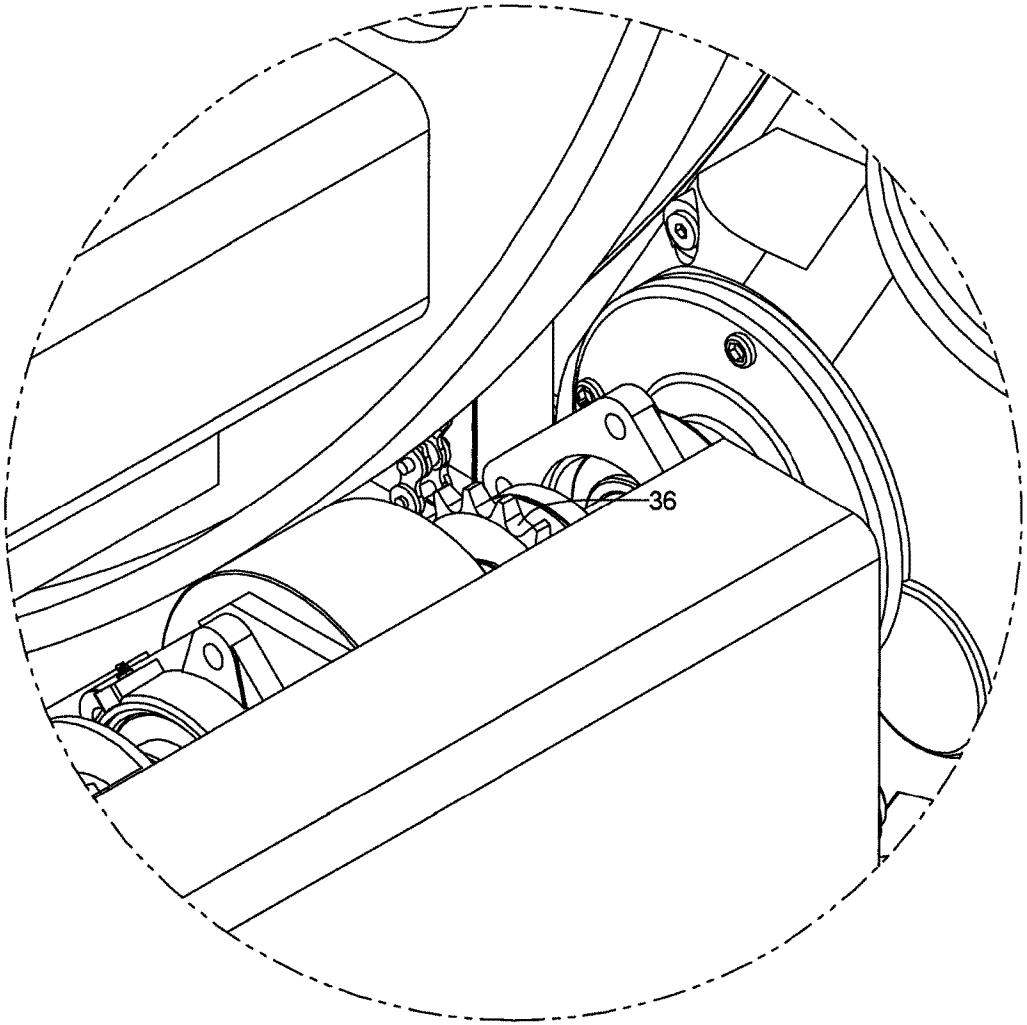
FIG. 11 is an enlarged perspective view of the chain and sprocket drive mechanism.
Figure 12:
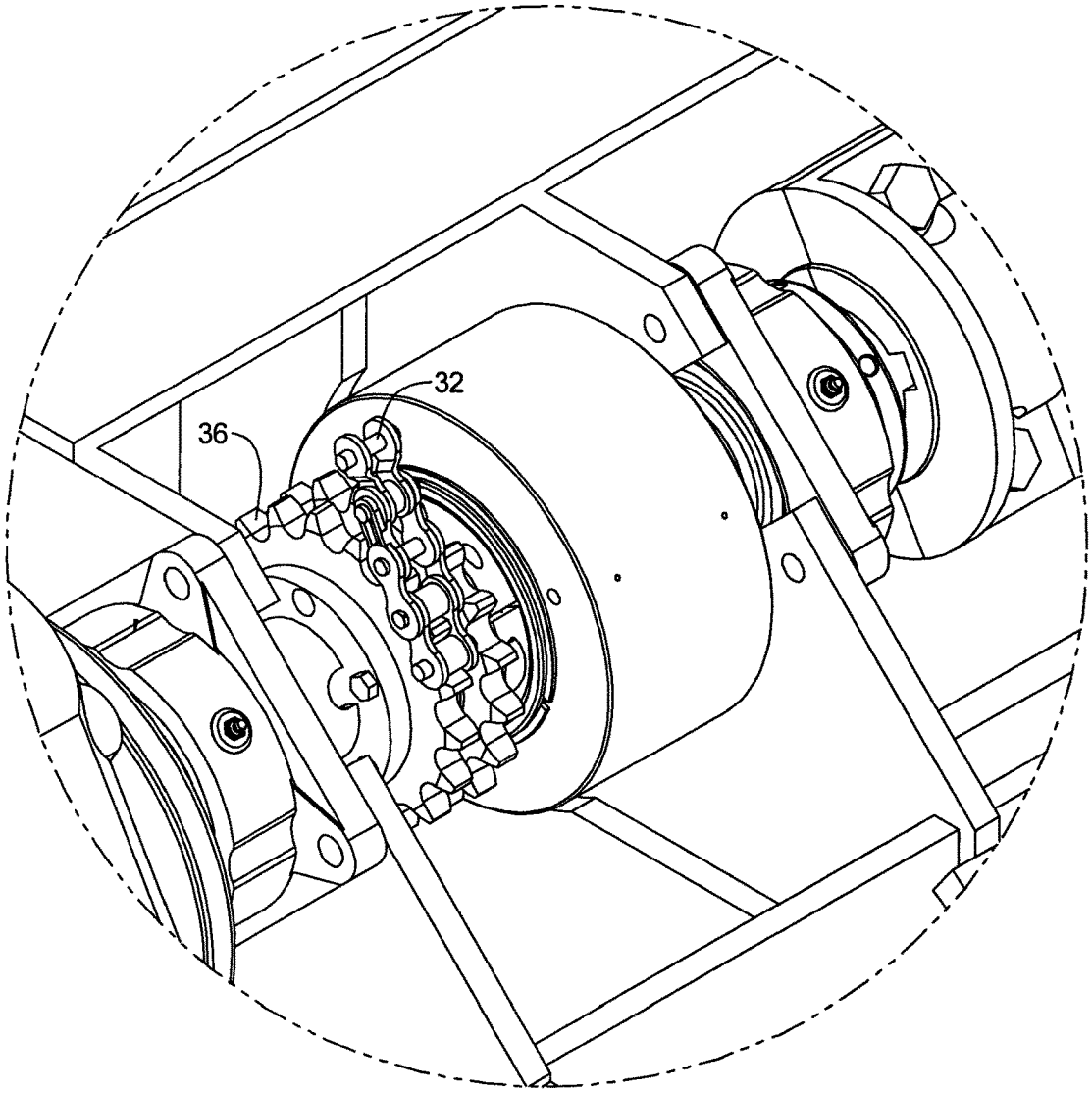
FIG. 12 is another enlarged perspective view of the chain and sprocket drive mechanism.

As illustrated in FIG. 8, the drive motor turns a shaft having a pair of sprockets 36 adjacent the rollers 28. These sprockets engage the chain 32. The chain is attached to the outer rim of the hub, as seen in FIG. 2, and the sprockets thus impart pushing and pulling movements to the chain, causing the drum to rotate in the desired clockwise or counterclockwise direction.

Figure 13:
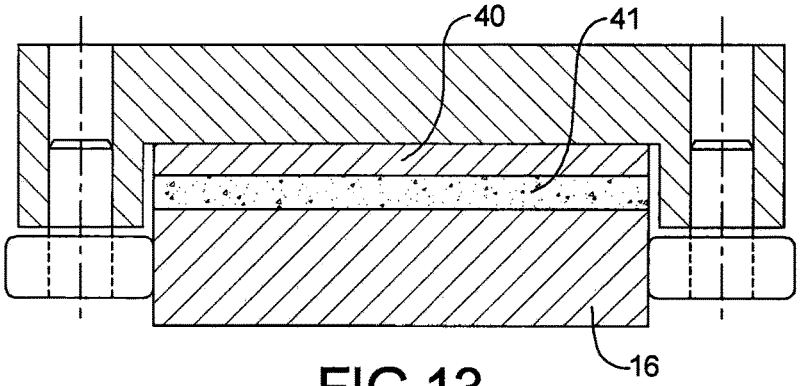
FIG. 13 is a cross-sectional view taken substantially along the line 13-13 of FIG. 6, showing the braking band and lining in greater detail.
Figure 6:
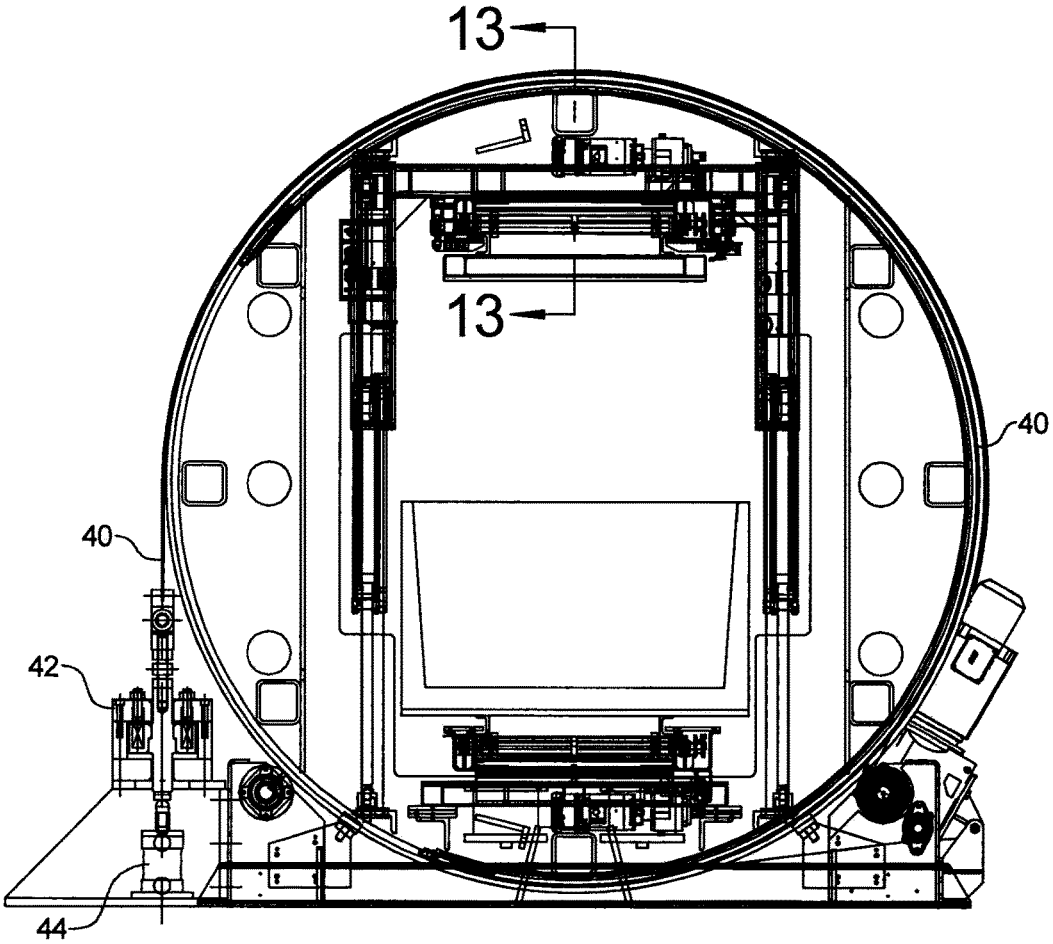
FIG. 6 is a cross-sectional view taken substantially along the line 6-6 in FIG. 5 and showing the spring mechanism and hydraulic release used to actuate the braking system.
Figure 7:
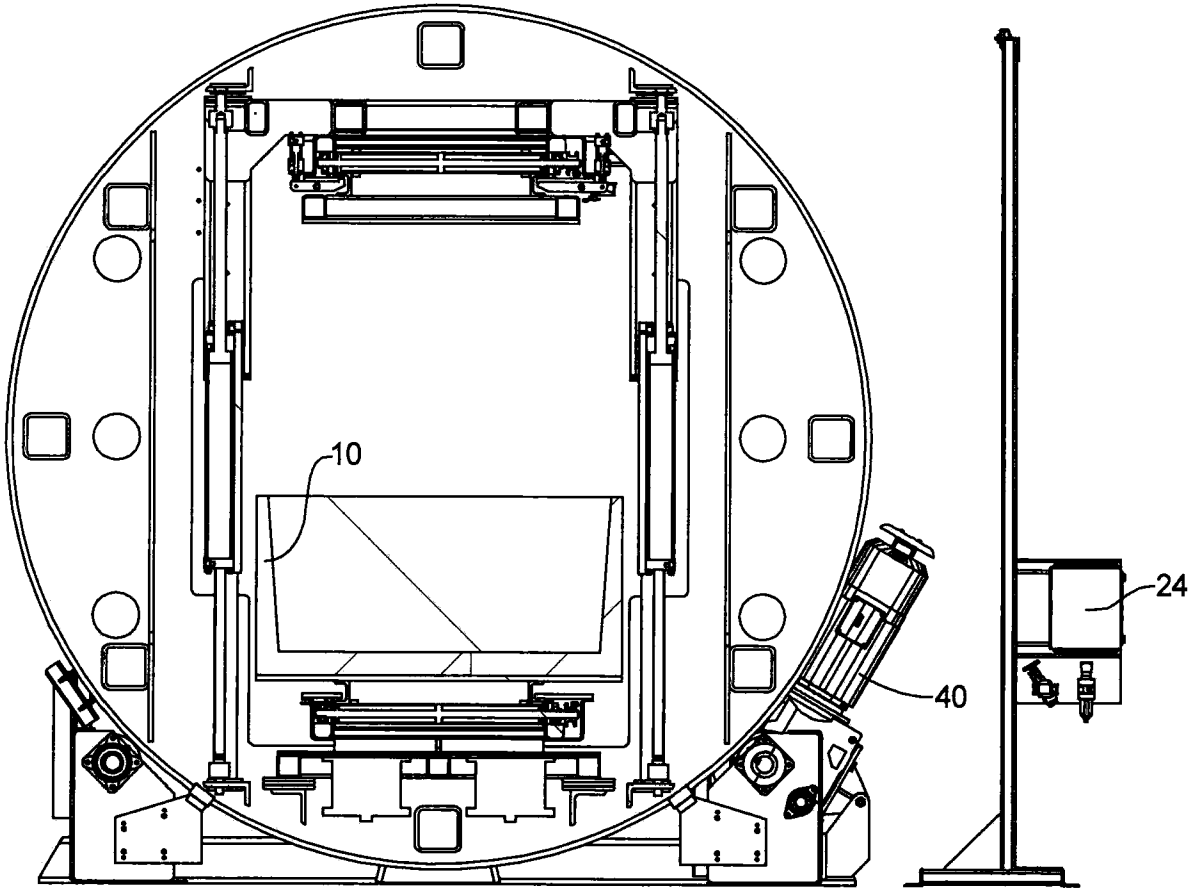
FIG. 7 is an opposite end view of the rollover machine, showing the pattern box in cross-section.

The braking mechanism is shown in FIG. 6. A steel band 40 lined with brake pad material 41 spans slightly more than 180 degrees of the outer periphery of the drum. Details of the brake pad lining and steel band are also seen in FIG. 13.

The band is held in tension by a hydraulically controlled spring mechanism 42. The spring mechanism is controlled by the hydraulic cylinder release mechanism 44 which, when energized, pushes the spring mechanism 42 into compression, loosening the pulling tension on the band, allowing the drum to rotate about its axis. When the hydraulic cylinder is de-energized, the compressed spring returns to its relaxed state, thereby pulling the steel band 40 in tension, so that the brake pad lining makes friction contact with the drum. In so doing, the braking bands cause the drum to stop rotation. The continued braking force of the bands against the drum hold the drum in a stationary position, resisting against any freewheeling forces that may exist due to loading and weight distribution of the rollover machine components and the pattern box and sand.

The hydraulic cylinder release mechanism 44 is electronically controlled. In an exemplary embodiment shown in FIG. 14, a pair of shaft encoders 50, such as optical encoders as illustrated, are attached to the rollover machine in suitable locations where they can rotate with rotation of the drum 16 (e.g., as with rollers 28) and drive mechanism (e.g., as with shaft 34). Preferably, these shaft encoders are configured or calibrated so that each produces a pulse train and such that the respective pulse trains are in synchronism during normal (non-freewheeling) operation. For example, the shaft encoders can be appropriately geared so that they turn at the same rate; or the encoders can be provided with electronic frequency dividing/multiplying electronics (e.g., using Flip-Flops or microprocessor circuitry, for example) so that they produce pulse trains in synchronism during normal operation.

Figure 14:
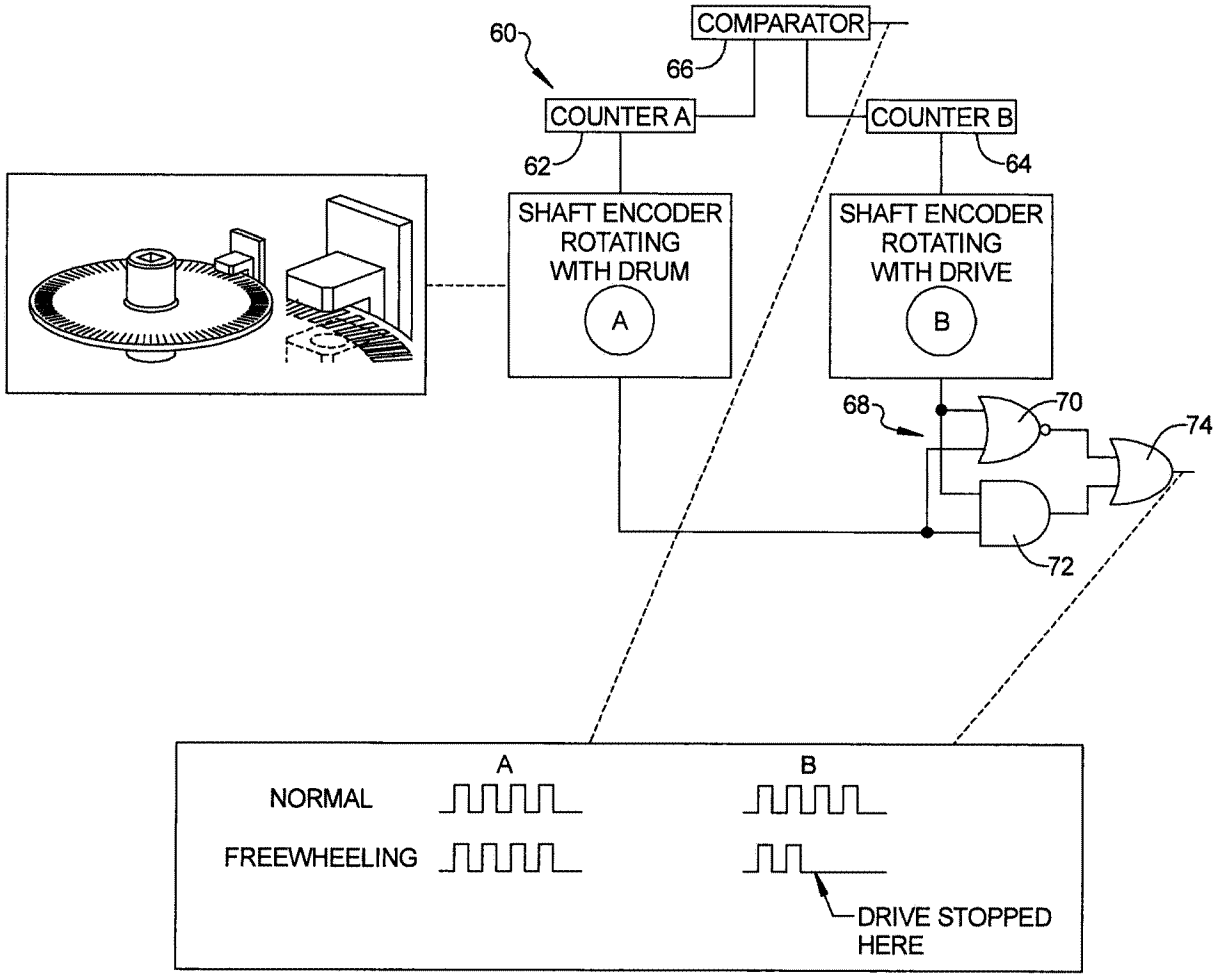
FIG. 14 is an electronic circuit diagram illustrating how freewheeling detection may be accomplished.

Two possible embodiments for decoding the shaft encoders are illustrated in FIG. 14. At 60 a pair of counters 62 and 64 count pulses from the respective shaft encoders A and B. A comparator 66 periodically samples the counter outputs (and then resets the counts). If the counts match, then normal conditions are signaled. If the counts do not match, then a freewheeling condition or error condition is signaled.

In the second embodiment, shown at 68, a collection of logic gates: NOR gate 70, AND gate 72, and OR gate 74 produce a truth table that decodes when the pulses do not occur in synchronism. When a lack of synchronism is detected, the freewheeling or error condition is signaled.

Of course, the described decoding functions can also be performed using a suitably programmed microprocessor or microcontroller.

Figure 15:
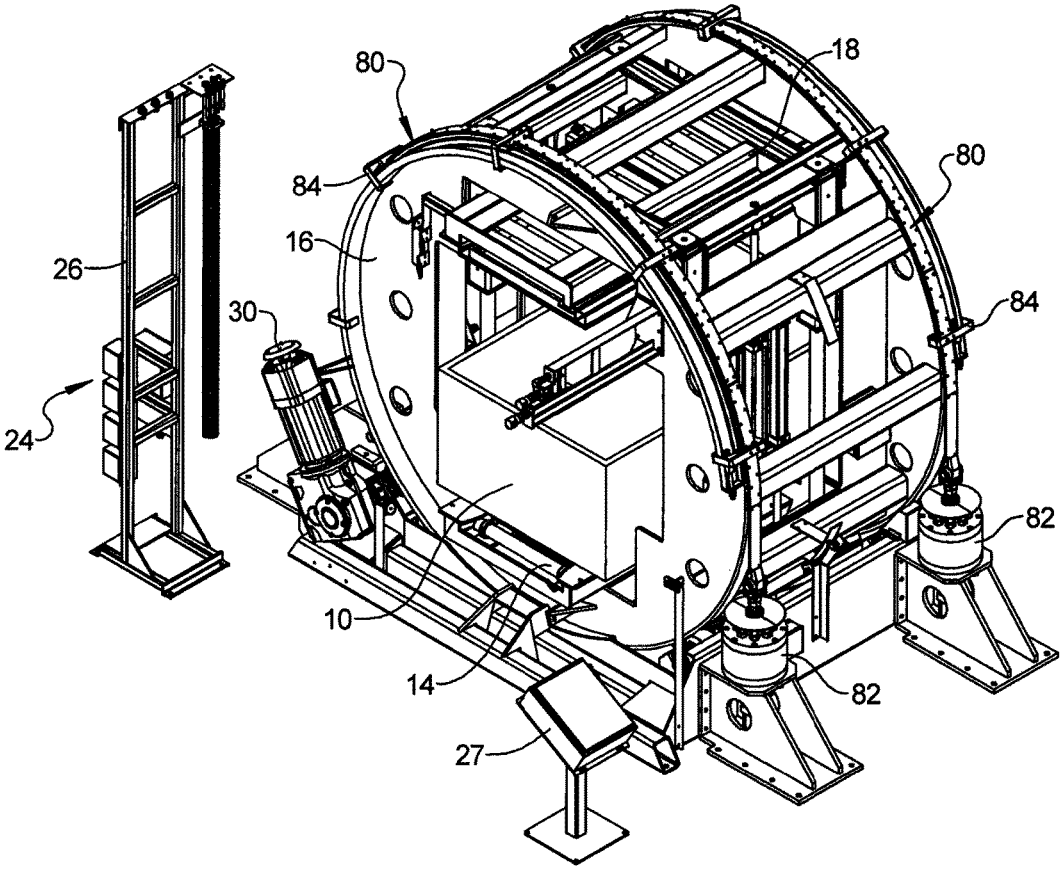
FIG. 15 is a perspective view of another embodiment of the rollover machine.

Referring to FIG. 15, another embodiment of the rollover machine is illustrated. As with the first embodiment, the rollover machine receives the pattern box 10 into drum 16 via the lower conveyor 14. The upper conveyor 18 is shown above the pattern box 10. As with the first embodiment, the drum is rotated by the drive motor 30. The electronic control panel 24 may be mounted on a suitable rack 26, as illustrated. An operator control console 27 is also included. Interconnecting cables between the control panel 24, control console 27 and the rollover machine have not been illustrated in FIG. 15.

In FIG. 15, two brake band assemblies 80 can be seen encircling the drum at the outer peripheries, as illustrated. The brake band actuator assemblies 82 are preferably supported at ground level and operate to apply braking pressure to the drum when signaled to do so by the control system based on signals received from the encoders, or actuation of an emergency stop button, as will be more fully explained.

Figure 16:
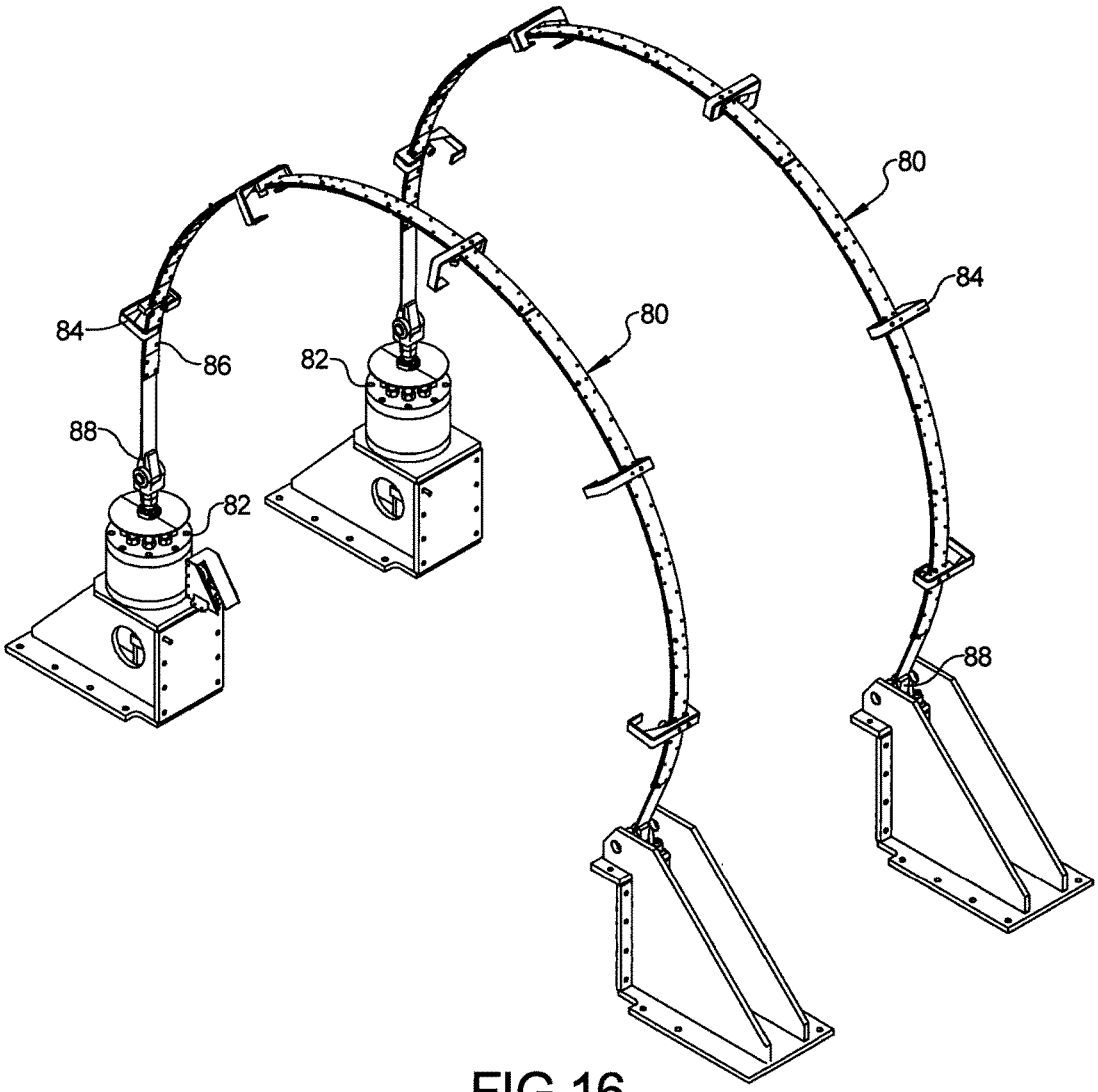
FIG. 16 is a perspective view showing the brake band assembly in greater detail.
Figure 17:
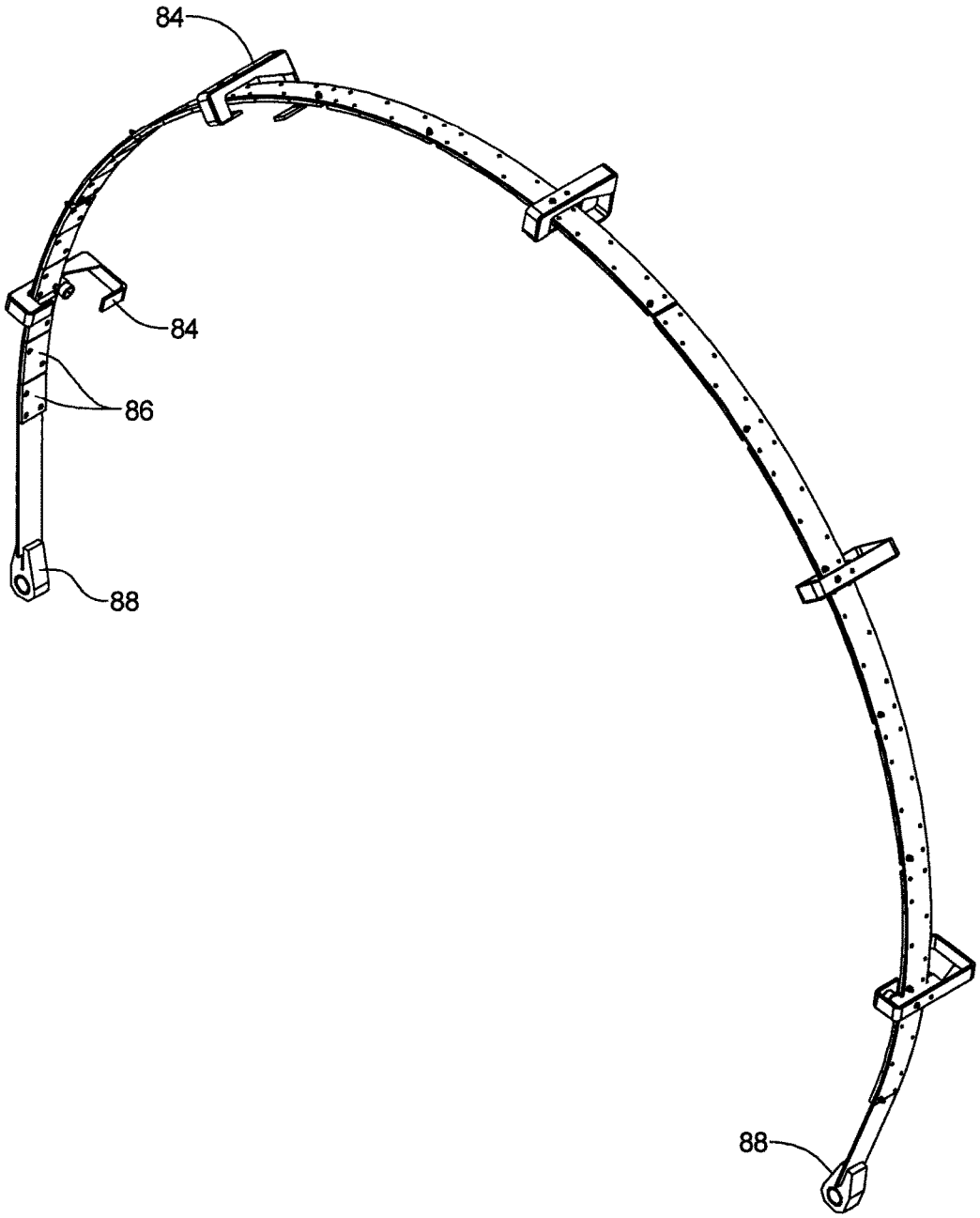
FIG. 17 is a perspective view showing the brake band in greater detail.
Figure 18:
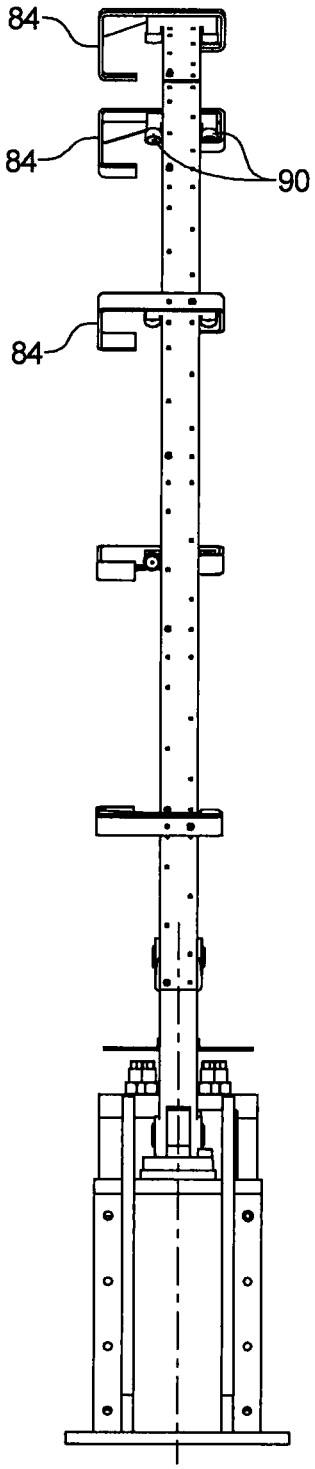
FIG. 18 is a side view of the brake band of FIG. 17.

Referring to FIGS. 16, 17 and 18, the brake band assemblies are shown in greater detail. Preferably, each band is welded together as a one-piece construction for equal load distribution. Each brake band is outfitted with a set of five band catches 84, also seen in FIG. 15, that restrain the brake band in place around the drum even in the unlikely event of a band breakage. Attached to each brake band are a series of brake pads 86 composed of brake material selected with a high coefficient of friction to increase stopping power. The pads are deployed as a series of sections for serviceability. The brake pads are preferably outfitted with a pair of deep slots (e.g., 0.12 inches wide by 0.25 inches deep) to catch brake pad wear debris. The brake material is selected to conform easily to the band radius. Preferably, the brake pads 86 may be bolted to the brake band to allow the pads to be replaced when worn. Welded to the ends of each band, a knuckle 88, comprising hardened steel bushings, is designed to mate with hardened steel pins for long wear life.

As shown in FIG. 18, each band assembly is outfitted with five follower cam side roller guides 90 to ensure that the band tracks correctly on the drum wheel.

Figure 19:
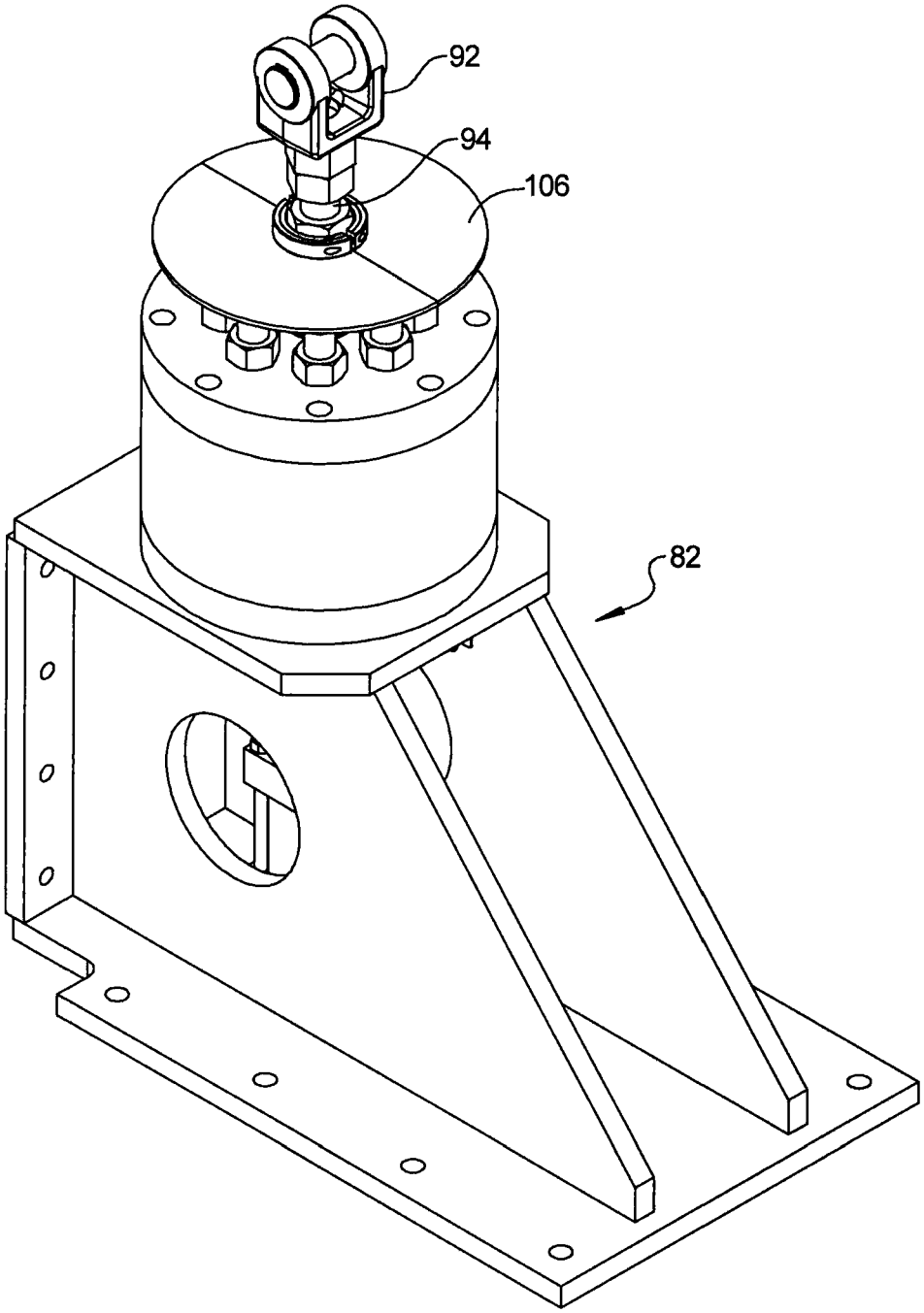
FIG. 19 is a perspective view of the brake actuator.
Figure 20:
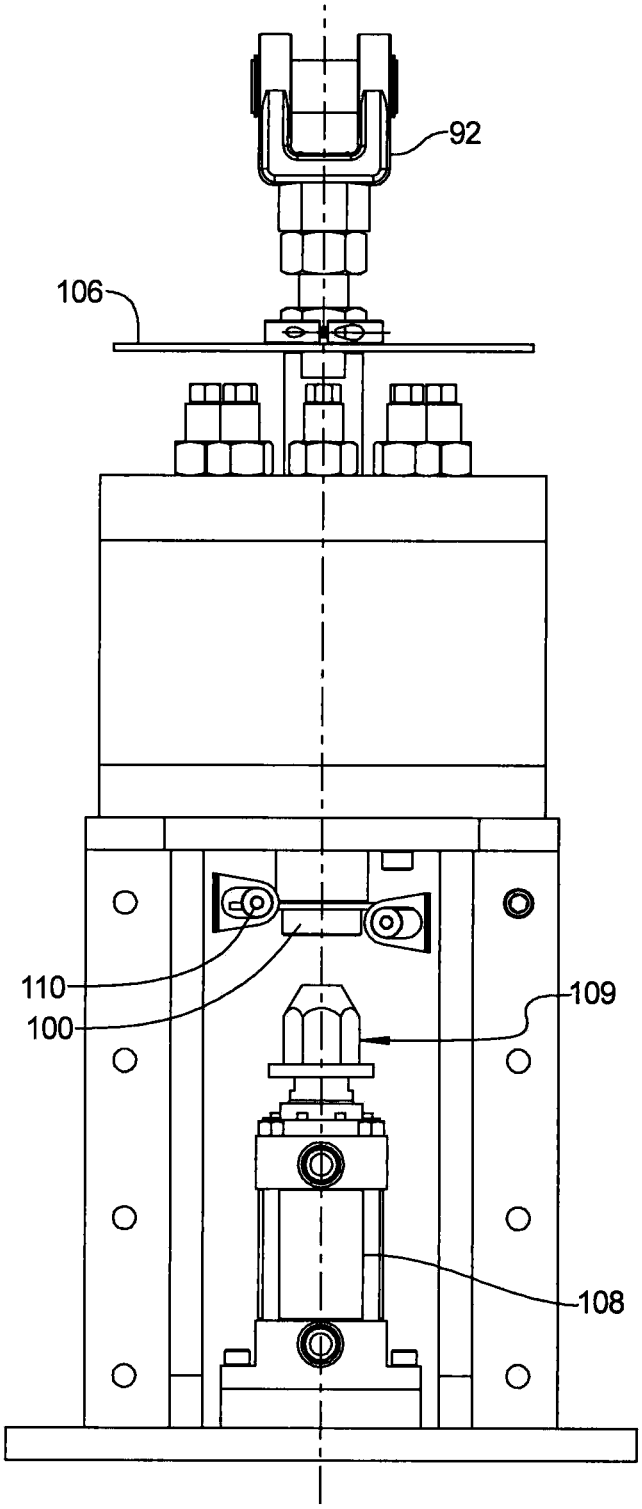
FIG. 20 is a detailed view of the brake actuator.
Figure 21:
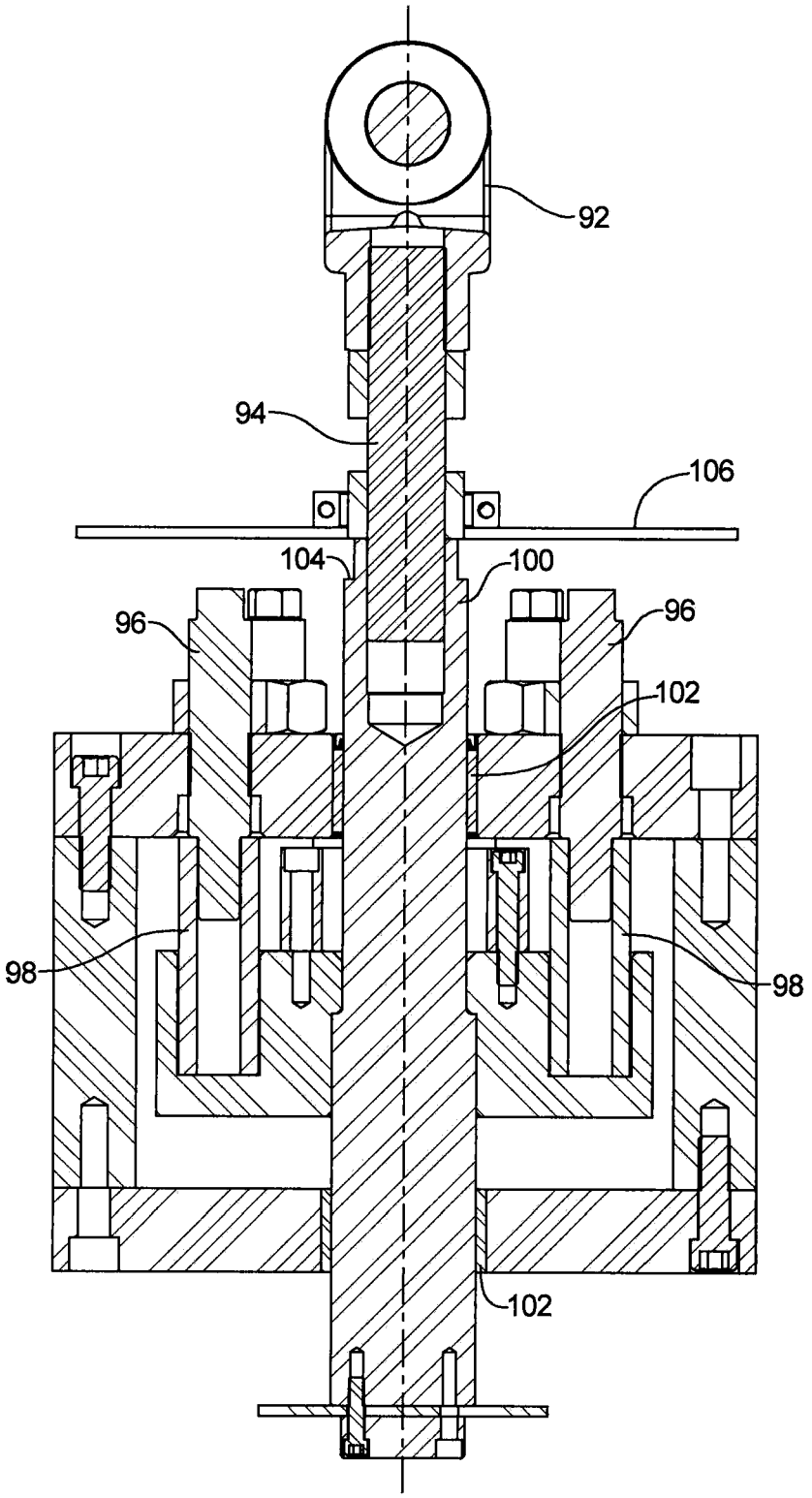
FIG. 21 is a cross-sectional view of the brake actuator sub assembly.

Shown in greater detail in FIGS. 19, 20 and 21, the brake actuator assemblies 82 each feature an actuator clevis 92 that is supported on a threaded rod 94 (see FIG. 21) to easily adjust the clevis to the pin connecting point on the band knuckle 88 (FIG. 17). As best seen in FIG. 21, spring adjusters 96 are used to pre-load die springs 98 to achieve the desired actuator brake load. The actuator shaft 100 is mounted in bronze bushings 102 for long life and bind-free movement. An internal hard stop 104 allows the brakes to be released consistently every time cycled. The actuator shaft uses a seal to keep foreign objects out of the shaft bearing. A sand guard 106 helps keep sand away from the shaft seal.

The actuator 82 uses die springs 98 to mechanically apply the brakes upon a system failure. A single acting hydraulic cylinder 108 (FIG. 20) applies a force in opposition to the die springs to release the brakes during normal rotation of the drum. Specifically, the hydraulic cylinder extends a deactivator pusher 109 that contacts the actuator shaft 100. Preferably, the hydraulic cylinder 108 is designed with dual ports on the cap end for high-speed free flow of oil when the brakes are mechanically applied. Proximity switches 110 shown in FIG. 20 detect when the brake pads are worn beyond a predetermined limit, indicating that the pads need to be replaced. The proximity switches also detect when an actuator adjustment is needed.

Figure 22:
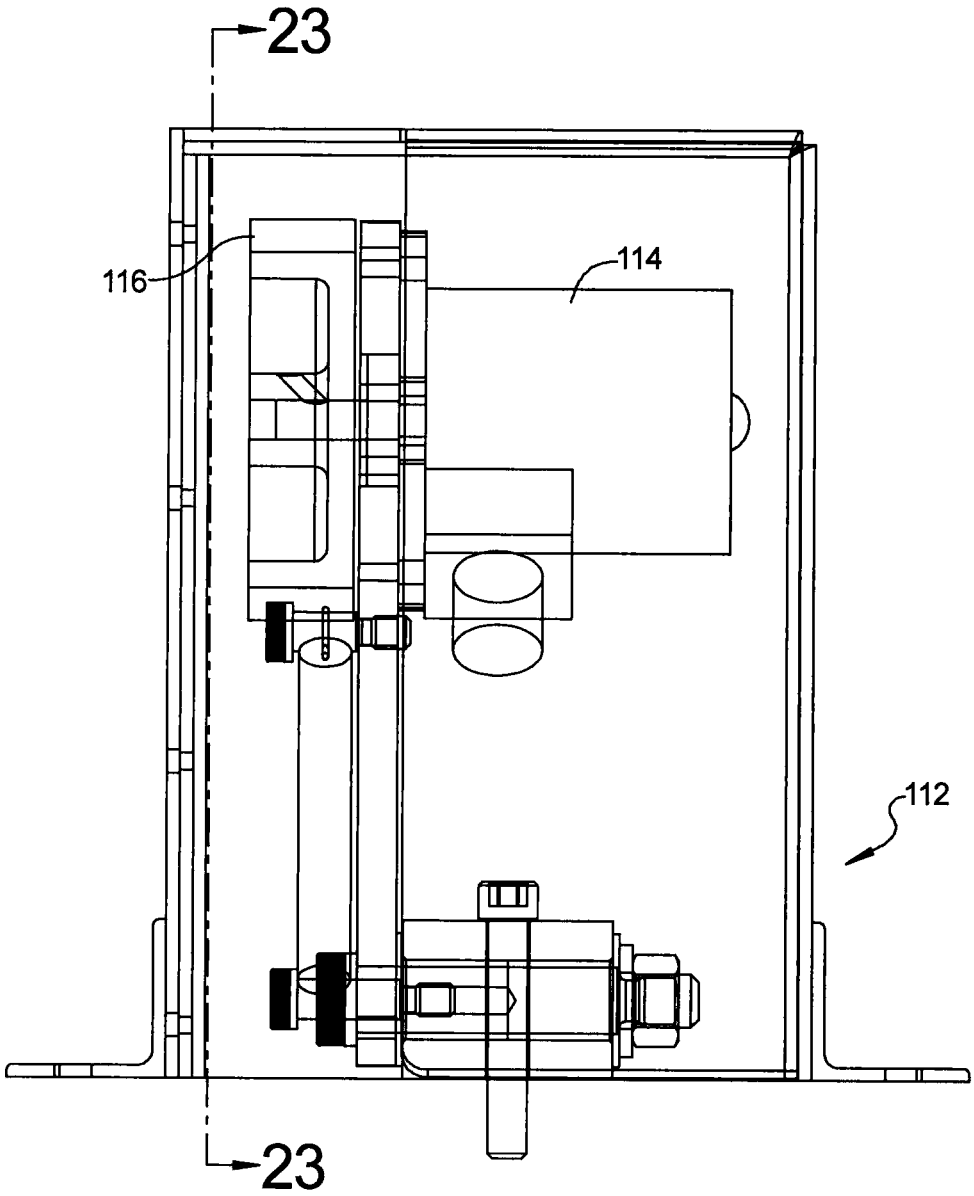
FIG. 22 is a side view of the encoder wheel sub assembly.
Figure 23:
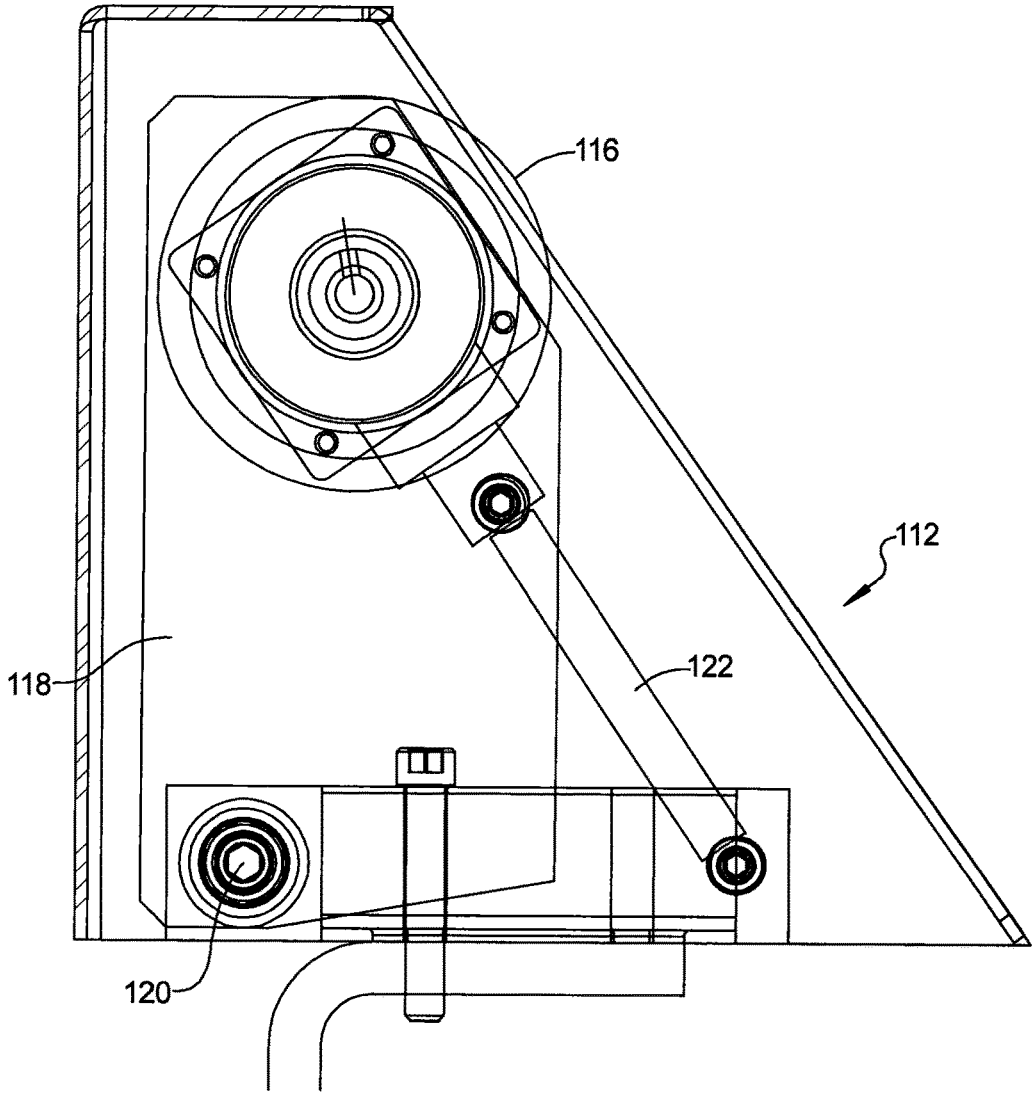
FIG. 23 is a cross-sectional view of the encoder wheel sub assembly taken along the line 23-23 in FIG. 22.

Shown in FIGS. 22 and 23, rotational motion of the drum is monitored by the drum encoder 112, which employs an external rotary encoder 114 driven by a wheel 116 that rides directly on the drum. The drum encoder automatically adjusts for wheel wear by being spring-loaded against the drum. This is accomplished, as perhaps best seen in FIG. 23, by a mounting plate 118 that is pivotally mounted at 120 and biased by extension spring 122.

The control system monitors the drive motor speed (measured by an encoder mounted on the drive motor) and compares it with the drum speed (measured by the external drum-mounted encoder). For a "freewheeling" condition, set points are established, and then set up and stored in the control system operating program. The brake will automatically apply if the speed increases or decreases outside these set points.

The band brake is monitored by the control system to ensure it releases correctly before the system will be allowed to rotate. The system is monitored for when the brake band is out of adjustment or brake pads are worn and this establishes a fault condition causing the brakes to be immediately applied. If a stop or decal switch fails during the roll cycle of the machine, a signal is immediately sent to apply the brakes.

Preferably, the control system is a programmed processor, programmed to cause the brakes to be automatically applied for the following conditions:

1. An emergency stop button is pressed;
2. Electric power is lost;
3. Hydraulic power unit fails;
4. Hydraulic hose failure on a brake release cylinder;
5. Main drive motor failure;
6. Main drive brake failure;
7. Breakage of both drum chains;
8. Stop or deceleration switch failure; and
9. System fault.

Note that the system has built-in redundancy, which allows for one-half the braking power should one of the two braking systems fail. Thus even if one of the two braking systems fails, the other braking system has sufficient stopping power to bring the rotating drum to a halt.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A rollover machine comprising:

a generally cylindrical drum driven for rotation about its axis by a drive mechanism;

a braking mechanism configured to selectively apply braking forces to the drum to thereby impede rotational movement of the drum;

a first movement sensor disposed to sense movement of the drive mechanism and producing a first output indicative of drive mechanism movement;

a second movement sensor disposed to sense movement of the drum and producing a second output indicative of drum movement;

an electronic comparator circuit that compares the first and second outputs and generates a control signal when the drive mechanism movement and drum movement are not in synchronism; and a control mechanism coupled to the comparator circuit and interfaced with the braking mechanism that causes the braking mechanism to apply braking forces to the drum when the control signal indicates the drive mechanism movement and drum movement are not in synchronism.

2. The rollover machine of claim 1 wherein the braking mechanism comprises at least one band that conforms to the outer periphery shape of the drum.

3. The rollover machine of claim 1 wherein the braking mechanism includes an actuator having a first state that applies braking forces to the drum and a second state that disengages the applied braking forces, wherein the actuator assumes the second state when controlled power is applied and wherein the actuator automatically assumes the first state when controlled power is removed.

4. The rollover machine of claim 1 wherein the braking mechanism includes a hydraulic actuator configured to disengage applied braking forces when hydraulic power is applied to the actuator.

5. The rollover machine of claim 1 wherein the braking mechanism includes an actuator that includes a spring mechanism that is biased to cause braking forces to be applied to the drum.

6. The rollover machine of claim 1 wherein the braking mechanism includes a hydraulic actuator that includes a spring mechanism that is biased to cause braking forces to be applied to the drum, wherein the actuator is configured to disengage applied braking forces when hydraulic power is applied to the actuator.

7. The rollover machine of claim 1 wherein the second movement sensor comprises an encoder coupled to a wheel held in frictional contact with a surface of the drum and operable to rotate in response to rotation of the drum.

8. The rollover machine of claim 7 wherein the second movement sensor is spring-biased into frictional contact with the drum.

9. The rollover machine of claim 1 wherein the control mechanism is a programmed processor, programmed to cause the braking mechanism to apply braking forces to the drum upon detection of at least one of a plurality of sensed conditions selected from the group consisting of: activation of an emergency stop button, loss of electric power, loss of hydraulic power, failure of a hydraulic hose on a brake release cylinder, failure of the drive mechanism, breakage of the drive linkages associated with the drive mechanism, defect in at least one of said movement sensors, and a processor system fault.

10. A rollover machine comprising:

a generally cylindrical drum driven for rotation about its axis by a drive mechanism;

a braking mechanism configured to selectively apply braking forces to the drum to thereby impede rotational movement of the drum;

a control mechanism having a first sensing point coupled to the drive mechanism and a second sensing point coupled to the drum and interfaced with the braking mechanism that causes the braking mechanism to apply braking forces to the drum when the drive mechanism movement and drum movement are not in synchronism.

11. The rollover machine of claim 10 wherein the braking mechanism comprises at least one band that conforms to the outer periphery shape of the drum.

12. The rollover machine of claim 10 wherein the braking mechanism includes an actuator having a first state that applies braking forces to the drum and a second state that disengages the applied braking forces, wherein the actuator assumes the second state when controlled power is applied and wherein the actuator automatically assumes the first state when controlled power is removed.

13. The rollover machine of claim 10 wherein the braking mechanism includes a hydraulic actuator configured to disengage applied braking forces when hydraulic power is applied to the actuator.

14. The rollover machine of claim 10 wherein the braking mechanism includes an actuator that includes a spring mechanism that is biased to cause braking forces to be applied to the drum.

15. The rollover machine of claim 10 wherein the braking mechanism includes a hydraulic actuator that includes a spring mechanism that is biased to cause braking forces to be applied to the drum, wherein the actuator is configured to disengage applied braking forces when hydraulic power is applied to the actuator.

16. The rollover machine of claim 10 wherein the second sensing point employs an encoder coupled to a wheel held in frictional contact with a surface of the drum and operable to rotate in response to rotation of the drum.

17. The rollover machine of claim 16 wherein the wheel coupled to the encoder is spring-biased into frictional contact with the drum.

18. The rollover machine of claim 10 wherein the control mechanism is a programmed processor, programmed to cause the braking mechanism to apply braking forces to the drum upon detection of at least one of a plurality of sensed conditions selected from the group consisting of: activation of an emergency stop button, loss of electric power, loss of hydraulic power, failure of a hydraulic hose on a brake release cylinder, failure of the drive mechanism, breakage of the drive linkages associated with the drive mechanism, defect in at least one of said movement sensors, and a processor system fault.

* * * * *